US010633907B2

(12) United States Patent
Null et al.

(10) Patent No.: US 10,633,907 B2
(45) Date of Patent: Apr. 28, 2020

(54) EDGE SENSOR FOR MOVABLE BARRIER

(71) Applicant: GTO Access Systems, LLC, Tallahassee, FL (US)

(72) Inventors: David Paul Null, Tallahassee, FL (US); Kevin Ward, Midlothian, TX (US)

(73) Assignee: GTO Access Systems, LLC, Tallahassee, FL (US)

( * ) Notice: Subject to any disclaimer, the term of this patent is extended or adjusted under 35 U.S.C. 154(b) by 213 days.

(21) Appl. No.: 15/614,898

(22) Filed: Jun. 6, 2017

(65) Prior Publication Data

US 2018/0347250 A1 Dec. 6, 2018

(51) Int. Cl.
*E05F 15/43* (2015.01)
*E05F 15/632* (2015.01)

(52) U.S. Cl.
CPC ..... *E05F 15/43* (2015.01); *E05F 15/632* (2015.01); *E05F 2015/434* (2015.01); *E05Y 2400/30* (2013.01); *E05Y 2400/612* (2013.01); *E05Y 2400/66* (2013.01); *E05Y 2400/80* (2013.01); *E05Y 2900/402* (2013.01)

(58) Field of Classification Search
CPC . E05F 15/00; E05F 15/42; E05F 15/43; E05F 15/40; E05Y 2400/822; G07C 9/00182
See application file for complete search history.

(56) References Cited

U.S. PATENT DOCUMENTS 5,037,552 A 8/1991 Furuta et al.
6,092,338 A * 7/2000 Crowner ..... E05F 15/643 49/360
6,600,113 B1 7/2003 Miller
6,651,385 B2 11/2003 Miller et al.
6,732,476 B2 5/2004 Mehalshick et al.
7,119,509 B1 10/2006 Keller et al.
7,123,144 B2 10/2006 Anderson et al.
7,127,847 B2 10/2006 Fitzgibbon et al.
7,170,248 B2 1/2007 Tsui et al.
7,224,275 B2 5/2007 Fitzgibbon
7,342,374 B2 3/2008 Robb et al.
7,420,347 B2 9/2008 Fitzgibbon et al.
7,518,326 B2 * 4/2009 Shier ..... E06B 9/68 318/16
8,176,684 B2 5/2012 Marchetto et al.
8,964,708 B2 2/2015 Petite et al.
9,574,387 B2 2/2017 Jankovsky et al.
9,587,420 B2 3/2017 Keller, Jr. et al.
(Continued)

OTHER PUBLICATIONS

"RBAND Monitored Wireless Gate TX/RX Model: RB-G_K10", MillerEdge, (2017), 1 pg.

*Primary Examiner* — Justin B Rephann
(74) *Attorney, Agent, or Firm* — Schegman Lundberg & Woessner, P.A.

(57) ABSTRACT

A system may include a first module and a second module. The first module may include a first transceiver, the first module configured to transmit a request using the first transceiver. The second module may include an input connection for an obstruction sensor and a second transceiver configured to receive a request from the first transceiver. The second module may be configured to receive sensor information from the obstruction sensor and send a response to the first module based on the sensor information.

18 Claims, 6 Drawing Sheets

(56) References Cited

U.S. PATENT DOCUMENTS

| | | | | |
|---|---|---|---|---|
| 2006/0132284 | A1* | 6/2006 | Murphy | G05B 19/042 340/5.7 |
| 2008/0016771 | A1* | 1/2008 | Marchetto | G07C 9/00182 49/26 |
| 2008/0224886 | A1* | 9/2008 | Rodriguez | G07C 9/00182 340/13.28 |
| 2011/0032073 | A1* | 2/2011 | Mullet | G07C 9/00182 340/5.7 |
| 2012/0112875 | A1* | 5/2012 | Heng | E05F 15/42 340/3.1 |
| 2012/0297681 | A1* | 11/2012 | Krupke | E05F 15/60 49/324 |
| 2013/0042530 | A1* | 2/2013 | Leivenzon | G01V 8/12 49/26 |
| 2013/0117078 | A1* | 5/2013 | Weik, III | G06Q 10/00 705/13 |
| 2014/0305599 | A1* | 10/2014 | Pimenov | E06B 9/68 160/7 |
| 2014/0347162 | A1* | 11/2014 | Zueras | E05F 15/43 340/5.71 |
| 2016/0002595 | A1 | 1/2016 | Keller et al. | |
| 2017/0002595 | A1* | 1/2017 | Keller, Jr. | E05F 15/40 |

* cited by examiner

EDGE SENSOR FOR MOVABLE BARRIER

BACKGROUND

Barriers can take a variety of forms, such as gates, garage doors, or retractable barriers that protrude or retract from below ground, or slide or otherwise move from above or from the side of an opening such as a door, hallway, driveway, or other route of passage.

Barriers may be opened using a variety of methods. A barrier may be simply pushed opened manually. Mechanized barriers may be opened by pressing a control device such as a button or lever that activates a motor or other device. Garages doors and gates can currently be opened via remote control devices that are carried by a person or stored in a car.

SUMMARY

This document discusses, among other things, systems and methods to obtain obstruction information to control a barrier operator by exchanging requests and responses between transceivers. The inventors have discovered, among other things, that a wireless system may be constructed by coupling a first transceiver to a barrier operator and a second transceiver to an obstruction sensor. In some examples, battery power in the second transceiver may be conserved by shifting the second transceiver from a low power state to a higher power state in response to receiving a request from the first receiver. In some examples, the second transceiver can wake itself from a low power state to communicate an event, such as detection of a low battery level or detection of an obstruction.

The subject matter (e.g., system) of Example 1 can include a first module including a first transceiver, the first module configured to transmit a request using the first transceiver, and a second module including an input connection for an obstruction sensor and a second transceiver configured to receive a request from the first transceiver, the second module configured to receive sensor information from the obstruction sensor and send a response to the first module based on the sensor information. The second module can optionally include a memory circuit and a processor, the memory circuit containing instructions executable by the processor to activate the second receiver responsive to receipt of the request through the second transceiver, receive sensed obstruction information from the obstruction sensor, and transmit the response using the second transceiver.

In Example 2, the subject matter of Example 1 may be configured so that the second transceiver transitions from a low power state to an active state responsive to receiving the request.

In Example 3, the subject matter of Example 1 or Example 2 may be configured such that the second transceiver is battery powered and the system conserves battery power by maintaining the second transceiver in the low power state and transmitting on request.

In Example 4, the subject matter of any one or any combination of Examples 1-3 can include a first module that is configured to sense an electromagnetic property of a barrier operator and transmit the request using the first transceiver responsive to the electromagnetic property exceeding a threshold.

In Example 5, the subject matter of any one or any combination of Examples 1-4 can include a first module that is configured to detect a voltage delivered to a barrier operator motor and transmit a request through the first transceiver responsive to the voltage exceeding a threshold.

In Example 6, the subject matter of any one or any combination of Examples 1-5 can optionally include the obstruction sensor. The obstruction sensor can, for example, include an optical sensor or a contact sensor.

In Example 7, the subject matter of any one or any combination of Examples 1-6 can optionally include a barrier operator including a drive system configured to move a barrier and a controller configured to control the drive system, wherein first module is configured to relay the response to the controller configured and the controller is configured to avoid driving the barrier into the obstruction when the response indicates that an obstruction is present.

In Example 8, the subject matter of any one or any combination of Examples 1-7 can optionally include a second transceiver that is configured to send a message to the first transceiver responsive to receiving a signal from the input connection.

In Example 9, the subject matter of any one or any combination of Examples 1-8 can optionally include a second transceiver that is configured to send a message to the first transceiver responsive to detecting a low battery status at the second transceiver.

The subject matter (e.g., system) of Example 10 can include an obstruction sensing system, and a sensor control system configured to couple to a barrier operator, the sensor control system in wireless communication with the obstruction sensing system. The sensor control system may be configured to send an obstruction sensor information request to the obstruction sensing system and the obstruction sensing system may be configured to receive the request and to send a response to the sensor control system.

In Example 11, the subject matter of any one or any combination of Examples 10 can include an obstruction sensing system that is configured to shift from a low-power state to a high power state responsive to receiving the request from the sensor control system.

In Example 12, the subject matter of Examples 10 or 11 can optionally include an obstruction sensing system that includes a first obstruction sensing sub-system that includes a first battery-powered transceiver. The first obstruction sensing sub-system may be configured to shift the first battery-powered transceiver from a low-power state responsive to receipt of the request from the sensor control system.

In Example 13, the subject matter of any one or any combination of Examples 10-12 can include a second obstruction sensing sub-system that includes a second obstruction sensor coupled to a second battery-powered transceiver, the second obstruction sensing sub-system configured to shift the second battery-powered transceiver from a lower-power state responsive to receipt of the request from the sensor control system. The first and second obstruction sensing systems can optionally share a communication channel, or can optionally each use a designated channel.

In Example 14, the subject matter of any one or any combination of Examples 10-13 can optionally be configured such that the sensor control system includes a first processor and a first memory circuit containing instructions executable by the first processor to detect activation of a barrier operator, send the request responsive to detecting activation of the barrier operator, receive the response from the obstruction sensing system, and transmit information based on the response to the barrier operator, and the obstruction sensing system includes a second processor and a second memory circuit containing instructions executable by the second processor to activate a transceiver responsive to receipt of the request, receive sensed obstruction information from the obstruction sensor, and transmit a response based on the sensed obstruction information to the sensor control system using the transceiver.

In Example 15, the subject matter of any one or any combination of Examples 10-14 can optionally include the barrier operator. The barrier operator can optionally include a barrier drive system configured to move a barrier and a barrier controller configured to control the barrier drive system, the barrier controller configured to receive the response from the sensor control system and, responsive to the response indicating that an obstruction is present, avoid driving the barrier into the obstruction.

The subject matter (e.g., a method) of Example 16 can include obtaining obstruction information to control a barrier operator by sending a first request for information using a first transceiver, receiving the first request for information using a second transceiver, receiving a first sensed obstruction status from a first obstruction sensor, and transmitting a response based on the sensed obstruction status from the second transceiver to the first transceiver.

In Example 17, the subject matter of Examples 16 can include shifting the second transceiver from a low-power mode to a higher power mode responsive to receiving the request.

In Example 18, the subject matter of Example 16 or Example 17 can include sending a second request for information using the first transceiver, receiving the second request for information using a third transceiver, receiving a second sensed obstruction status from a second obstruction sensor, and transmitting a second response based on the second sensed obstruction status from the third transceiver to the first transceiver. Example 18 can optionally include a 3rd obstruction sensor including a $4^{th}$ transceiver and 5th obstruction sensor including a transceiver.

In Example 19, the subject matter of any one or any combination of Examples 16-18 can include detecting activation of the barrier operator, where the request for information is sent responsive to detecting activation of the barrier operator.

In Example 20, the subject matter of any one or any combination of Examples 16-19 can include relaying the response to the barrier operator.

An example (e.g., "Example 21") of subject matter (e.g., a system or apparatus) may optionally combine any portion or combination of any portion of any one or more of Examples 1-20 to include "means for" performing any portion of any one or more of the functions or methods of Examples 1-20, or a "machine-readable medium" (e.g., massed, non-transitory, etc.) including instructions that, when performed by a machine, cause the machine to perform any portion of any one or more of the functions or methods of Examples 1-20.

This summary is intended to provide an overview of subject matter of the present patent application. It is not intended to provide an exclusive or exhaustive explanation of the disclosure. The detailed description is included to provide further information about the present patent application. Other aspects of the disclosure will be apparent to persons skilled in the art upon reading and understanding the following detailed description and viewing the drawings that form a part thereof, each of which are not to be taken in a limiting sense.

BRIEF DESCRIPTION OF THE DRAWINGS

In the drawings, which are not necessarily drawn to scale, like numerals can describe similar components in different views. Like numerals having different letter suffixes can represent different instances of similar components. The drawings illustrate generally, by way of example, but not by way of limitation, various embodiments discussed in the present document.

DETAILED DESCRIPTION

Information to control a barrier operator may be acquired using two or more transceivers that wirelessly communicate information from a remote device such as a sensor to a device that may communicate with a controller for a barrier operator. For example, a first module, which may be local to a controller for a barrier operator, may include a first transceiver that may communicate a request. In some examples, the first module may detect activation of a barrier operator (e.g., detect power to a gate motor or door opener motor), and send a request responsive to detecting the activation of the barrier operator. A second module may be coupled to an information-gathering device, such as a sensor, and may be configured to receive the request from the first transceiver. The second module may receive information from the sensor (or other information-gathering device) and send a response based on the received information via the second transceiver. In some examples, the second module may be battery powered. By detecting gate activation and sending a request for gate status when the gate is activated, battery power may be conserved, because the second transceiver may be configured to expend energy to transmit information on-demand (e.g., only when needed), such as in response to detection of gate activation. In some examples, the second transceiver may be configured to shift from a low power state and transmit information responsive to an event detected by the second module, such as detection of low battery status or detection of an obstruction.

Figure 1:
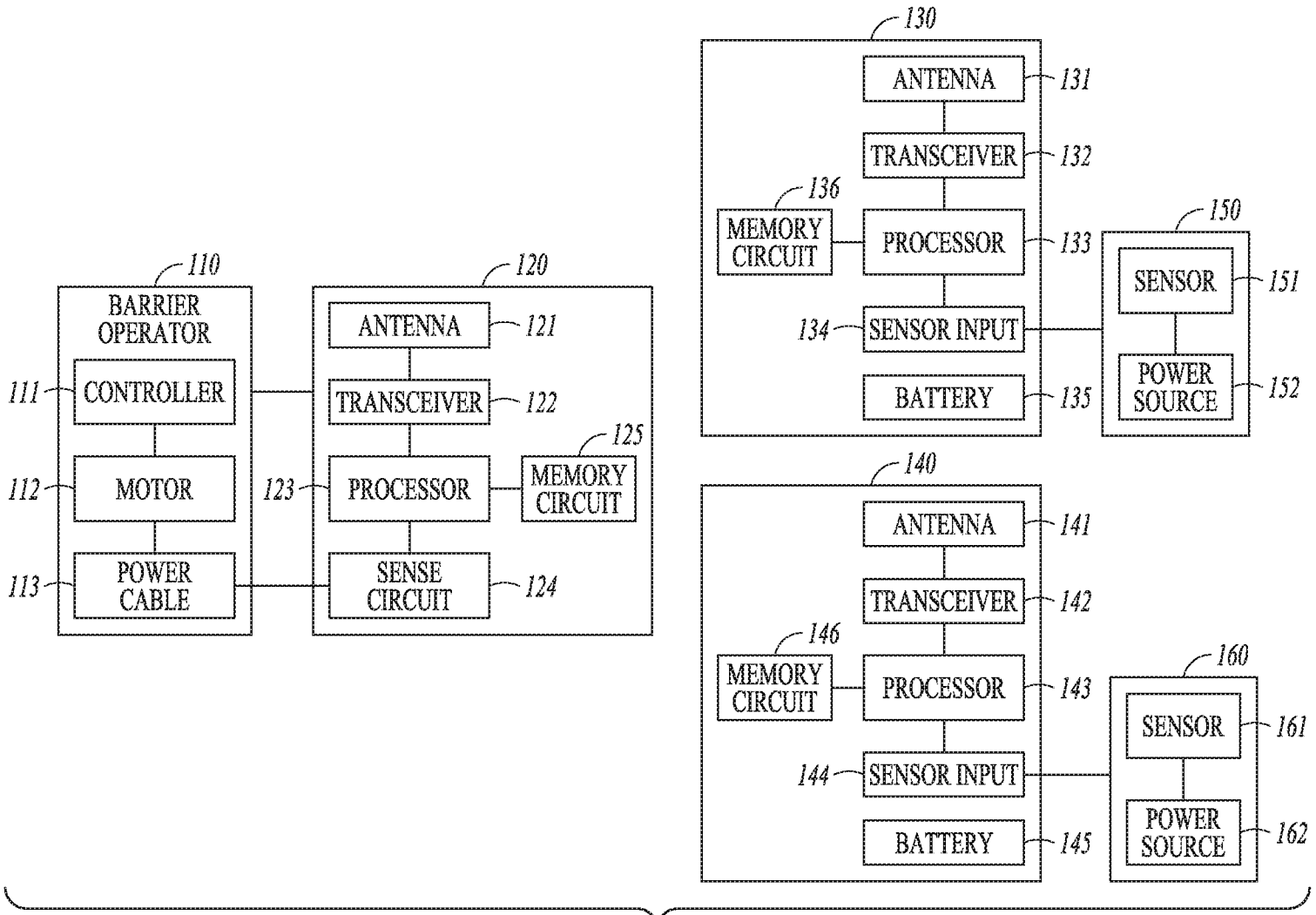
FIG. 1 is a schematic diagram of a system that may obtain obstruction information from one or more sensors and communicate obstruction status information to a barrier operator.

FIG. 1 is a schematic diagram of a system 100 that may obtain obstruction information from one or more sensors 150, 160 and communicate obstruction status information to a barrier operator 110. The system 100 may include a first module 120 that may include a transceiver 122 that may be configured to transmit a signal through an antenna 121, for example to send a request for sensor information. In some examples, the first module 120 may be configured to draw power from the barrier operator 110. In other examples, the first module 120 may include a power supply (not shown), or may be batter powered. The first module 120 may also include a back-up battery power source (not shown.)

The first module 120 may also include a processor 123. The processor 123 may be configured to retrieve and execute instructions stored on a memory circuit 125 to monitor for barrier operator activation and transmit a request for sensor information responsive to detection of barrier operator activation.

The first module 120 may be configured to sense an electromagnetic property of the barrier operator. For example, the first module may include a sense circuit 124. In an AC sense configuration, the sense circuit 124 may be configured to sense an electromagnetic field from the barrier operator. The sense circuit 124 may, for example, be configured to sense an electromagnetic field surrounding a cable 113 that supplies power to a barrier operator motor 112. In some configurations, the sense circuit 124 may be physically coupled or connected to the cable 113. While the sense circuit is illustrated as coupled to the power cable 113, an electromagnetic field could be sensed from other components of the barrier operator, such as the motor. An electrical signal generated by the sense circuit in response to the presence of alternating current in the cable 113 may be amplified or filtered or both. The processor may detect the signal and may trigger transmission of a sensor request via the first transceiver 122 responsive to the raw or filtered or amplified signal exceeding a threshold.

In a DC sense configuration, the sense circuit 124 may detect a motor voltage via a conductor connected to the motor 112. The first module 120 may compare the voltage delivered to a barrier operator motor to a threshold. The first module 120 may transmit a request through the first transceiver responsive to the voltage exceeding a threshold.

In some examples, a vibration sensor may be used to detect activation of the barrier operator. For example, a vibration sensor may be coupled to the motor 112, to a housing or other structural component, to the barrier, or to linkage components that couple the barrier to the motor. The vibration sensor may, for example, include an accelerometer that generates an electrical signal in response to acceleration (movement) caused by activation of the motor or movement of the barrier or linkage components that couple the motor to the barrier.

In some examples, barrier activation can be detected by a motion sensor. A motion sensor may, for example, sense movement by a motor, a barrier, or linkage components that couple a motor to a barrier. A motion sensor may include an optional or infrared sensor, for example.

In some examples, a combination of two or more sensors may be used to detect activation of a barrier operator. In some examples, using a combination of sensors can increase the sensitivity of detection, specificity of detection, or may increase both sensitivity and specificity. In some configurations, a barrier activation is declared when one or more of a plurality of sensor systems indicates that the barrier activation, e.g. by detection of a voltage, acceleration, or movement. In some configurations, barrier operator activation is declared only when two (or more) sensor systems provide a signal that indicates that the barrier operator has been activated. Declaring barrier activation by fewer (e.g., just one) sensor systems more reliably assures that an obstruction sensor reading will be provided to the barrier controller, but may expend more battery power in response to false detections (e.g., if acceleration, is detected but the acceleration was not actually caused by a barrier activation.

In any of the above examples, the first module may send a sensor request in response to detection of activation of the barrier operator to obtain sensed obstruction information for the controller.

In another example, the first module 120 may receive a request from the controller 111, which may trigger the first module 120 to transmit a sensor information request via the transceiver 122. In a configuration where the first module receives a request from the barrier operator controller 111, the sense circuit 124 and motor activation sensing described above may not be needed. In some examples, a barrier activation sensing system as described above may be used to confirm a signal from a controller, or may be used as a backup system to avoid the potential for barrier activation that is not communicated to the first module by the controller.

The system 100 may include a second module 130 that may obtain sensor information from a sensor device 150. The second module 130 may include an antenna 131, a transceiver 132, a processor 133, a sensor input 134, a battery 135, and a memory circuit 136. The second module may be configured to be controlled by the processor 133, which may retrieve stored instructions from the memory circuit 136 and execute the instructions, e.g. to provide sensor information on request. The sensor input 134 may be configured to receive a signal from sensor device 150.

The second module may be a battery-powered device, powered by battery 135, which may be rechargeable, replaceable, or both. The second module 130 may be configured to operate in a low power state, which may, for example, be a listen-only state, i.e. a state in which the transceiver 132 listens for a signal (e.g., a request from the first transceiver 122), but does not transmit. The low power state may include a duty cycle, which may limits the power consumption by periodically waking up the transceiver to listen and then putting the transceiver back into a sleep state. The second module may be configured to, responsive to receiving a request, (e.g., a request from the first transceiver 122), transition from the low power state to a higher power state. For example, the second module 130 may activate the transceiver to enable transmission of information to the first transceiver 122 in response to a request from the first transceiver 122. In an example exchange, the first module 120 may detect activation of the barrier operator, for example by detecting an electromagnetic field or DV voltage, and transmit a request for sensor information, which may be received by the second module 130, and responsive to receiving the request, the second module 130 may receive information from the sensor device 150, and formulate a response based on the received information (e.g., a binary response to indicate obstruction, or no obstruction, or a force reading to indicate a force exerted on the sensor device 150, or a displacement reading from the sensor device), and the second module 130 may transmit the response to the first module using transceiver 132. The first module 120 may receive the response and transmit the response or information based on the response to the controller 111 of the barrier operator 110.

Sensor device 150 may include a sensor 151 and a power source 152, which may be a battery, or may be an AC transformer or other AC power source. The sensor device 150 may include an output which is coupled by a wire or other coupling mechanism to the sensor input 134 on the second module 130. Sensor device 150 may, for example, include a contact sensor, such as an edge sensor on a door or gate that may close an electrical contact on the sensor 151 when an edge encounters an obstruction. In another example, the sensor device may include an optical sensor, such as an optical trip wire. For example, the sensor 151 may be an optical receiver that receives a light beam (e.g., laser) and is configured to detect an interruption in the light beam, which may indicate that an obstruction is present in the beam path.

The system 100 may include a third module 140, which may include an antenna 141, transceiver 142, processor 143, sensor input 144, battery 145, and memory circuit 146. The third module may be coupled a second sensor device 160, which may be the same type as sensor device 150, or may be a different type of device 160. The second sensor device 160 may include a sensor 161 and a power source 162 which may be a battery or an AC source. In some examples, the first module 120 may transmit a request, to which both the second module 130 and third module 140 respond. In other examples, the first module 120 may transmit separate requests that include header or other information that specify the module that is to respond to the request, and the second 120 module or third module 140 may be configured to respond when specified by the request issued by the first module. In some examples, four, five, or more modules may operate together.

Figure 2:
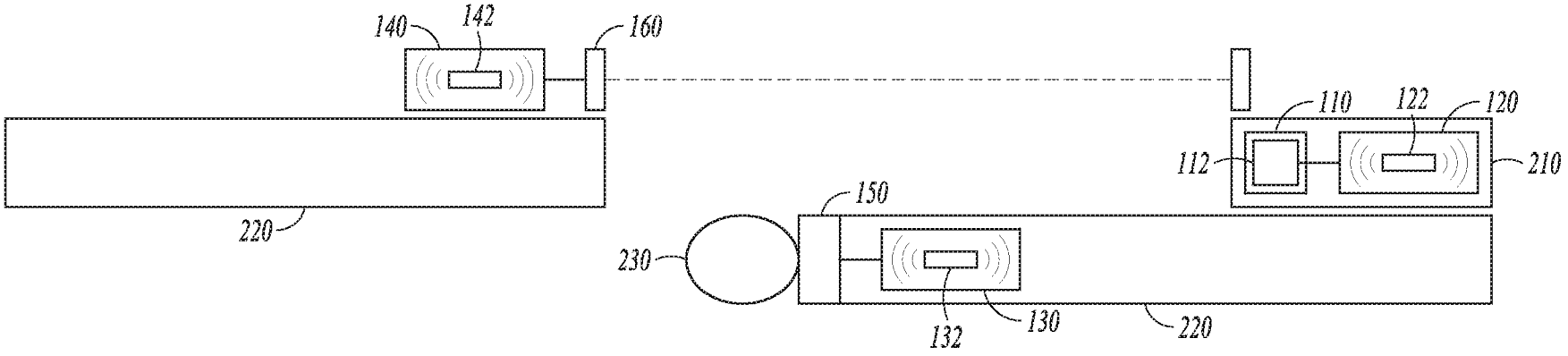
FIG. 2 is a schematic top view illustration of a system that includes the first module installed in on a structure such as a wall or fence and the second module installed on a gate adjacent second structure.

FIG. 2 is a schematic top view illustration of a system 200 that includes the first module 120 installed in on a structure 210 such as a wall or fence and the second module 130 installed on a gate 220 adjacent second structure 215. The first module 120 may detect activation of the motor 112 on barrier operator 110 that may trigger transmission of a sensor information request through the transceiver 122 in the first module 120. The transceiver 132 on the second module 130 may receive the request and receive a sensor status from the sensor device 150. In FIG. 2, an edge sensor is depicted as encountering an obstruction 230. In this scenario, the sensor device 150 would provide the second module with information that indicates that an obstruction has been encountered (e.g. an electrical contact on sensor has been pushed into a closed state), and the second module 130 may transmit a response to the first module 120. The first module 120 may relay the response to the barrier operator, or process the response to provide appropriate information discernable by barrier operator, and the controller (shown in FIG. 1) on the barrier operator may stop advancement of the gate or retract the gate, e.g. by sending a control instruction to the motor 112.

The system 200 may also include the third module 140, which may be coupled to an optical sensor device 160. The optical sensor device 150 is depicted on an opposite side of the structure 220 for clarity of illustration, but in practice may be positioned in line with the barrier.

In some examples, the second module 130 or third module 140 may proactively send a notification of obstruction to the first module responsive to detection of an obstruction, or detection of a low battery status, even if a request has not been received. In other examples, the second module 130 or third module may send a transmission only in response to a request from the first module, which may result in longer battery life due to less frequent transmissions.

In some examples, a sensor control system 260 may include the first module 120 and may be configured to control send sensor information requests when sensor information is needed as input for the barrier operator HO. In some examples, an obstruction sensing system 250 may include the sensor device 150 and second module 130, that may, for example, detect an encounter with an obstruction and communicate the detected obstruction via the transceiver 132 in the second module 130. In some examples, an obstruction sensing system 250 may include a plurality of obstruction sensing subsystems, which may each include a sensor device and a module that includes a transceiver that may respond to sensor information requests from a sensor control system. One or more of the obstruction sensing subsystems may be battery powered, and may maintain a transceiver in a low power state (e.g., listening periodically for a request from a sensor control system), and may shift the transceiver to a higher power state (e.g. more actively listening, or transmitting a response with sensor information) in response to receiving a request. In some examples, two, three, four, or more sensors and respective transceivers may detect obstruction status information and each send a response to the sensor control system. In some examples, a sensor control system may send a request that may be received by two or more obstruction sensing sub-systems. In some examples, a sensor control system may send requests that specify which of a plurality of obstruction sensing sub-systems is to respond to a particular request.

Figure 3:
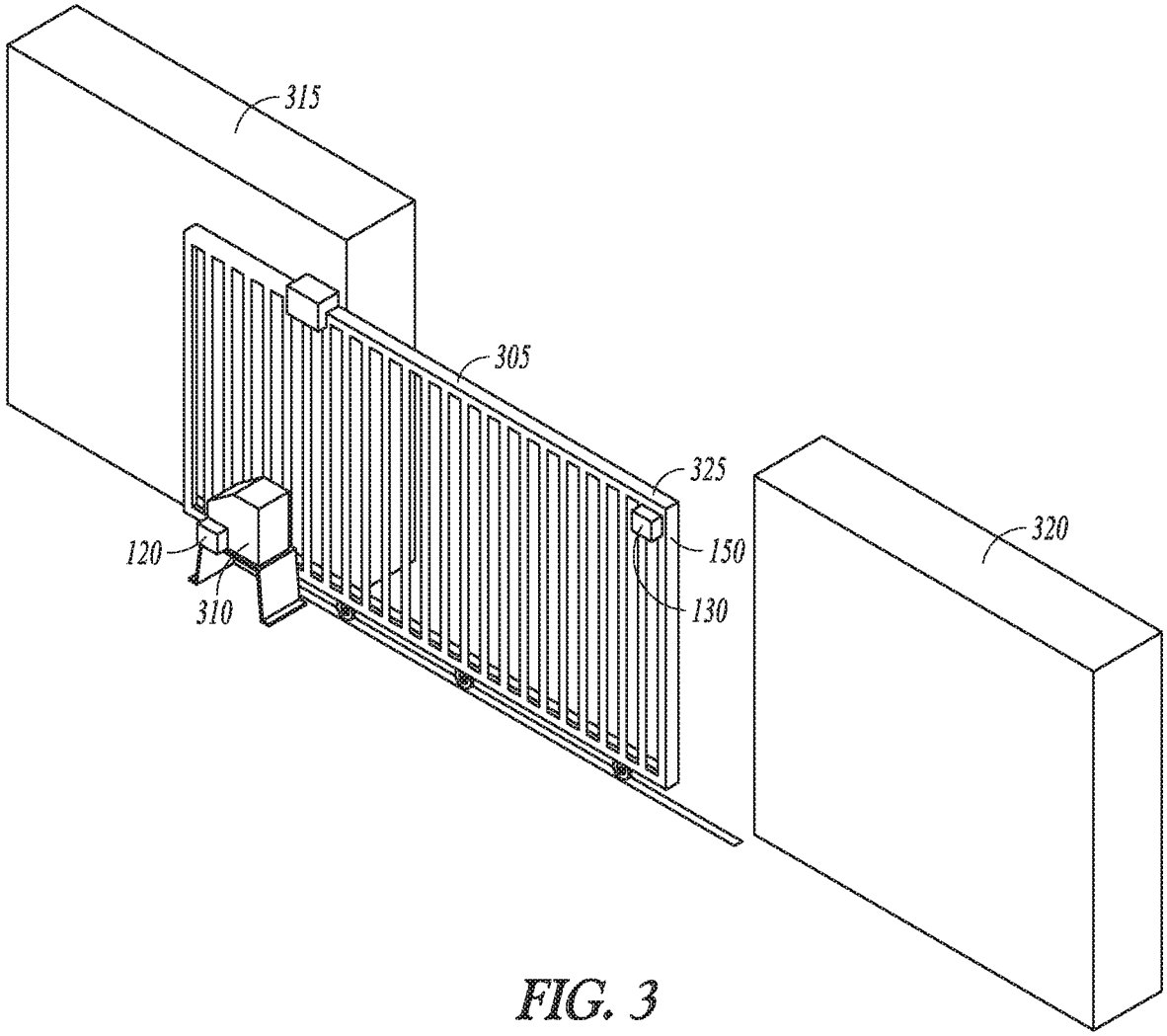
FIG. 3 is a perspective illustration of an example system with a barrier that may be moved by a barrier operator to open and close a passage between two wall structure.

FIG. 3 is a perspective illustration of an example system 300 with a barrier 305 that may be moved by a barrier operator 310 to open and close a passage between two wall structures 315, 320. The sensor device 150 may be installed on a leading edge 325 of the barrier 305.

Figure 4:
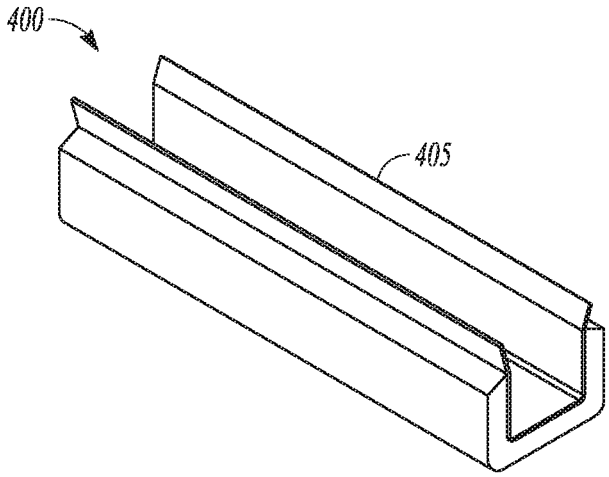
FIG. 4 is a perspective illustration of an example edge sensor.

FIG. 4 is a perspective illustration of an example edge sensor 400. The edge sensor 400 may be installed on a leading edge of a barrier 305, such as the barrier shown in FIG. 3. The edge sensor 400 may be configured with a gap between an electrical contact 405 on the edge sensor 400 and a contact (not shown) installed on the barrier, such that when the edge sensor 400 encounters an obstacle, the contacts are pressed together to create an electrical signal. In alternative configurations, the edge sensor 400 may be configured to detect interruption or diffraction of a light source, electromagnetic effects caused by movement or displacement, stress or strain detected by a piezo sensor, to detect contact with an obstacle or an amount of displacement or force exerted on the sensor.

Figure 5:
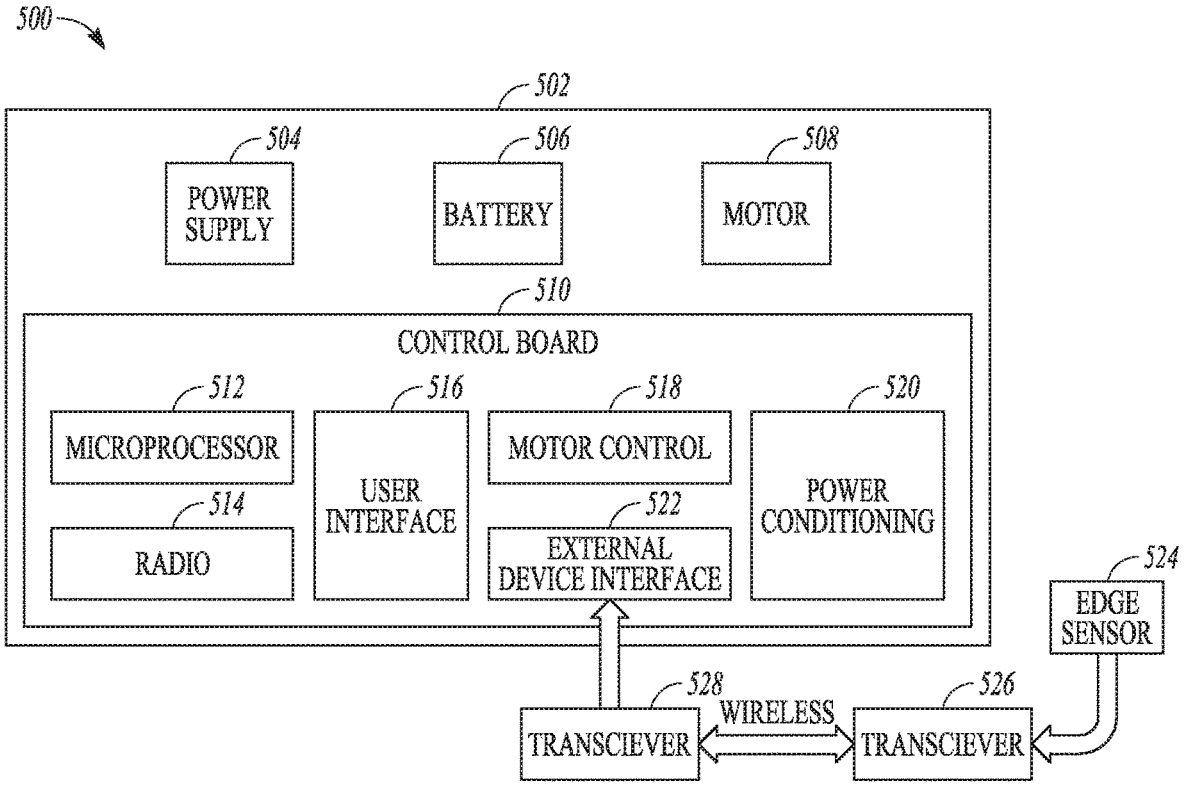
FIG. 5 is a schematic illustration of an example barrier operator.

FIG. 5 is a schematic illustration of an example barrier operator system 500 that may include a barrier operator 502 that may be operatively coupled (e.g. wired or wireless) to a first transceiver 528. The barrier operator 502 may, for example, include a gate operator or garage door opener. The barrier operator system 500 may also include a sensor 524, which may be an edge sensor or other type of obstruction-detecting sensor, and a second transceiver 526 operatively coupled (wired or wireless) to the edge sensor. The barrier operator 502 may include a power supply 502, battery 504, and motor 506 that may be controlled through a control board 510. The control board 510 may include a microprocessor 512 that may be coupled to a radio unit 514, which may for example include a cellular transceiver or local wireless technology (e.g. WiFi™, Bluetooth™, Zigbee™), and may communicate with a stationary or handheld remote control (not shown).

A user interface 516 may be coupled to the processor 512 to allow for user inputs to program or control the barrier operator 502. The user interface 516 may include buttons, a touch screen interface, voice recognition technology, or other user input functionality. The barrier operator 502 may also include a motor control circuit 518 that may receive instructions from the microprocessor 9012, or directly from the user interface. A power conditioning unit 520 may condition AC power for use by the motor 506. The motor control circuit 518 may control the motor by delivery of conditioned AC power to the motor (in which case the battery may supply backup power, or motor control circuit may deliver power to the battery, and the battery may power the motor 506 and move a barrier. In some examples, the power delivery may be detected by the first module 120, as described above in reference to FIG. 1. In some examples, the motor control circuit 518 may send a signal to the first module 120, which may trigger transmission via a transceiver of a request for sensor information. The control board 510 may also include an external device interface 522 that may receive sensor information from the first module 110. The microprocessor 512 or motor control unit 518 may receive signals from the sensor interface 522 and interrupt operation of the motor 506 when an obstruction is detected by the safety beam sensor.

The edge sensor 524 may be one of the sensors 151, 161 shown in FIG. 1. The first transceiver 528 may be the transceiver component 122 of the first module 120 shown in FIG. 1, and the second transceiver 526 may be the transceiver component 132 of the second module 130 or the transceiver component 142 of the third module 140. The a first transceiver 528 may be configured to wirelessly communicate with the second transceiver 526 (e.g. via WiFi™ Bluetooth™, Zigbee™) to enable, for example, transmission of a sensor information request from the first transceiver 528 to the second transceiver 526 and transmission of a response based on information from the sensor 524 from the second transceiver 526 to the first transceiver 528 and through the external device interface 522 to the microprocessor, which may use the sensor information to control the barrier (e.g. move the barrier using the motor 508, or stop movement in response to detection of an obstacle).

Figure 6:
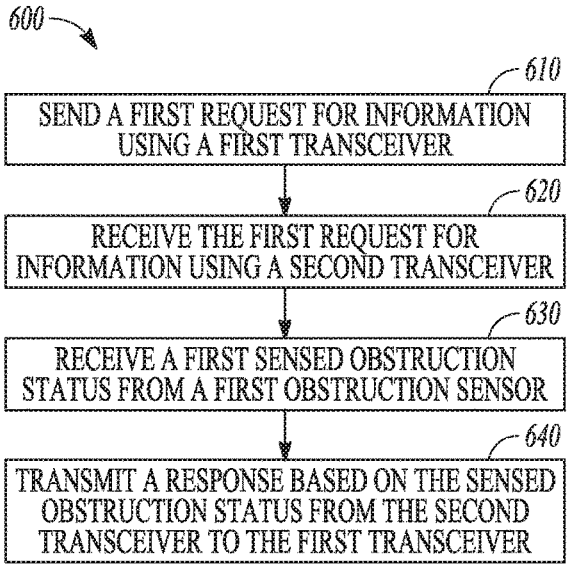
FIG. 6 is a flow chart illustration of an example method.

FIG. 6 is a flow chart illustration of an example method 600. At 610, a first request is send using a first transceiver. The first transceiver may be a part of a first module as shown in FIG. 1. At 620, the first request may be received by a second transceiver and described above. The second transceiver may be a part of a second module as shown in FIG. 1 and described above. At 630, a first obstruction status may be received from a first obstruction sensor. The first obstruction sensor may be the sensor device shown in FIG. 1 and described above. At 640, the second transceiver may transmit a response based the sensed obstruction status. The response may be received by the first transceiver, which may pass the response, or information based on the response, to a controller of a barrier operator to inform control of the barrier operator, e.g., stopping movement of a barrier in response to detection of an obstruction.

Figure 7:
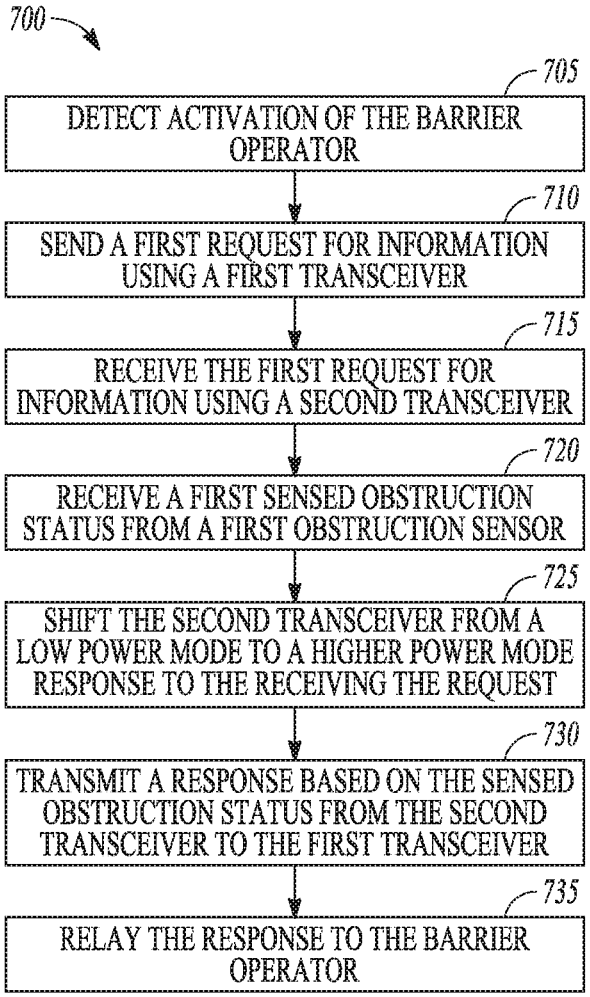
FIG. 7 is a flow chart illustration of an example method.

FIG. 7 is a flow chart illustration of an example method 700. At 705, activation of a barrier operator may be detected. At 710, a first request for information is sent using a first transceiver. The request for information may be sent responsive to detecting activation of the barrier operator. At 715, a first request for information may be received using a second transceiver. At 720, first sensed obstruction status may be received from a first obstruction sensor. At 725, the second transceiver is shifted from a low-power mode to a higher power mode responsive to receiving the request. At 730, a response based on the sensed obstruction status is transmitter from the second transceiver to the first transceiver. At 735, the response may be relayed to the barrier operator. The barrier operator may, for example, stop moving a barrier to avoid driving a barrier into an obstacle.

Figure 8:
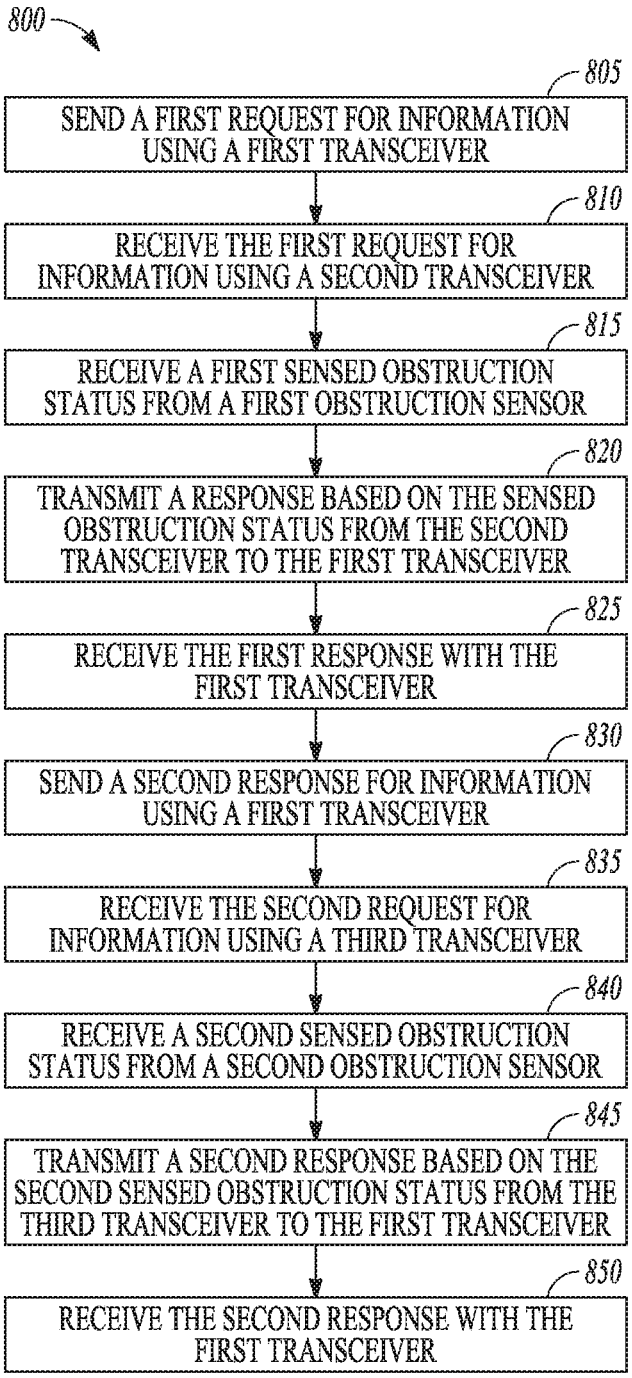
FIG. 8 is a flow chart illustration of an example method.

FIG. 8 is a flow chart illustration of an example method. At 805, a first request is send using a first transceiver. The first transceiver may be a part of a first module as shown in FIG. 1. At 810, the first request is received by a second transceiver. The second transceiver may be a part of a second module as shown in FIG. 1 and described above. The module may shift the second transceiver from a low power mode (e.g. listening only) to a higher power mode (e.g. transmission mode) in response to receiving the request. The module may, for example, shift the transceiver when the request is received, or when the module is ready to transmit a response. At 815, a first obstruction status is received from a first obstruction sensor. The first obstruction sensor may be the sensor device shown in FIG. 1 and described above. At 820, the second transceiver may transmit a first response based the sensed obstruction status. At 825, the first response may be received by the first transceiver. The first module may pass the response, or information based on the response, to a controller of a barrier operator to inform control of the barrier operator, e.g., stopping movement of a barrier in response to detection of an obstruction. At 830, a second request is send using the first transceiver. At 835, the second request is received by a third transceiver. The third transceiver may be a part of a third module as shown in FIG. 1 and described above. At 840, a second obstruction status is received from a second obstruction sensor. At 845, the third transceiver may transmit a second response based the second obstruction status. At 850, the first response may be received by the first transceiver. In some examples, the method may further include sending requests and receiving responses from third, fourth, or more modules as described above to enable communication with third, fourth, or more sensors.

In various examples, any of the steps of the methods illustrated in FIGS. 6, 7, and 8 may be combined in any combination. The methods may be used in combination with various types of sensors, and is not limited to use with obstruction sensors. Example methods may include steps performed in different order than illustrated or described.

The above detailed description includes references to the accompanying drawings, which form a part of the detailed description. The drawings show, by way of illustration, specific embodiments in which the invention may be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein may be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code may be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with U.S. 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed. Description as examples or embodiments, with each claim standing on its own as a separate embodiment, and it is contemplated that such embodiments may be combined with each other in various combinations or permutations. The scope of the invention should be determined with reference to the appended claims, along with the full scope of equivalents to which such claims are entitled.

What is claimed is:

1. A system comprising:

a first component including a first transceiver, the first component configured to:

detect a voltage delivered to a barrier operator motor; and transmit a request using the first transceiver, responsive to the voltage exceeding a threshold, the request indicating that the barrier operator motor has been activated; and a second component affixed to a moveable barrier, the second component including an input connection for an obstruction sensor and a second transceiver configured to:

receive the request from the first transceiver;

wake up from a low power state responsive to receiving the request;

receive sensor information from the obstruction sensor after waking up; and send a response to the first component based on the sensor information, the response indicating an obstruction in a path of the moveable barrier.

2. The system of claim 1, wherein the second transceiver is battery powered and the system conserves battery power by maintaining the second transceiver in the low power state and transmitting on request.

3. The system of claim 1, wherein the first component is configured to sense an electromagnetic property of a moveable barrier operator and transmit the request using the first transceiver responsive to the electromagnetic property exceeding a threshold.

4. The system of claim 1, further comprising the obstruction sensor.

5. The system of claim 1, further comprising a moveable barrier operator including a drive system configured to move the movable barrier and a controller configured to control the drive system, wherein the first component is configured to relay the response to the controller and wherein the controller is configured to avoid driving the barrier into the obstruction when the response indicates that an obstruction is present.

6. The system of claim 1, wherein the second transceiver is configured to send a message to the first transceiver responsive to receiving a signal from the input connection.

7. The system of claim 1, wherein the second transceiver is configured to send a message to the first transceiver responsive to detecting a low battery status at the second transceiver.

8. A system comprising:

an obstruction sensing system affixed to a moveable barrier; and a sensor control system configured to couple to a moveable barrier operator, the sensor control system in wireless communication with the obstruction sensing system;

wherein the sensor control system is configured to:

receive an indication of a detected voltage delivered to a motor controlled by the moveable barrier operator; and send an obstruction sensor information request to the obstruction sensing system responsive to the voltage exceeding a threshold, the request indicating that the motor has been activated; and wherein the obstruction sensing system is configured to:

receive the request;

wake up from a low power state responsive to receiving the request;

obtain obstruction information; and send a response to the sensor control system, the response indicating an obstruction in a path of the moveable harrier based on the obstruction information.

9. The system of claim 8, wherein the obstruction sensing system is configured to shift from the low-power state to a high power state responsive to receiving the request from the sensor control system.

10. The system of claim 9, wherein the obstruction sensing system includes a first obstruction sensing sub-system that includes a first battery-powered transceiver, the first obstruction sensing sub-system configured to shift the first battery-powered transceiver from a low-power state responsive to receipt of the request from the sensor control system.

11. The system of claim 10, further comprising a second obstruction sensing sub-system that includes a second obstruction sensor coupled to a second battery-powered transceiver, the second obstruction sensing sub-system configured to shift the second battery-powered transceiver from a lower-power state responsive to receipt of the request from the sensor control system.

12. The system of claim 8, wherein:

the obstruction sensing system includes a processor and a memory circuit containing instructions executable by the processor to activate a transceiver responsive to receipt of the request, receive sensed obstruction information from the obstruction sensor, and transmit a response based on the sensed obstruction information to the sensor control system using the transceiver.

13. The system of claim 8, further comprising the moveable barrier operator, the moveable barrier operator including a barrier drive system configured to move the movable barrier and a barrier controller configured to control the barrier drive system, the barrier controller configured to receive the response from the sensor control system and, responsive to the response indicating that an obstruction is present, avoid driving the barrier into the obstruction.

14. A method of obtaining obstruction information to control a moveable barrier operator, comprising:

receive an indication of a detected voltage delivered to a motor controlled by the moveable barrier operator;

sending a first request for information using a first transceiver, responsive to the voltage exceeding a threshold, the request indicating that the motor has been activated;

receiving the first request for information using a second transceiver;

waking up a first obstruction sensor, affixed to a moveable barrier, from a low power state responsive to receiving the first request using the second transceiver;

receiving a first sensed obstruction status from the first obstruction sensor after the first obstruction sensor is woken up; and transmitting a response based on the sensed obstruction status from the second transceiver to the first transceiver, the response indicating an obstruction in a path of the moveable barrier.

15. The method of claim 14, further comprising shifting the second transceiver from a low-power mode to a higher power mode responsive to receiving the request.

16. The method of claim 14, further comprising:

sending a second request for information using the first transceiver;

receiving the second request for information using a third transceiver;

receiving a second sensed obstruction status from a second obstruction sensor; and transmitting a second response based on the second sensed obstruction status from the third transceiver to the first transceiver.

17. The method of claim 14, further comprising detecting activation of the moveable barrier operator, where the request for information is sent responsive to detecting activation of the moveable harrier operator.

18. The method of claim 14, further comprising relaying the response to the moveable barrier operator.

* * * * *